US008647051B2

(12) United States Patent
O'Connor et al.

(10) Patent No.: US 8,647,051 B2
(45) Date of Patent: Feb. 11, 2014

(54) HIGH EFFICIENCY LOW-PROFILE CENTRIFUGAL FAN

(75) Inventors: John F. O'Connor, New Hartford, CT (US); Jan Najman, Harwinton, CT (US); Michael C. Brauer, New Hartford, CT (US)

(73) Assignee: The Bergquist Torrington Company, Torrington, CT (US)

( * ) Notice: Subject to any disclaimer, the term of this patent is extended or adjusted under 35 U.S.C. 154(b) by 774 days.

(21) Appl. No.: 12/876,619

(22) Filed: Sep. 7, 2010

(65) Prior Publication Data

US 2011/0064570 A1 Mar. 17, 2011

Related U.S. Application Data

(60) Provisional application No. 61/242,853, filed on Sep. 16, 2009.

(51) Int. Cl.
*F04D 29/30* (2006.01)

(52) U.S. Cl.
USPC ..... 415/102; 415/206; 416/183; 416/185; 416/196 A; 416/202; 416/223 B; 416/210 R; 416/211; 416/238; 416/243; 416/DIG. 2

(58) Field of Classification Search
USPC ..... 415/102, 204, 206; 416/179, 182, 183, 416/185, 186 R, 187, 191, 193 R, 194, 195, 416/196 R, 196 A, 202, 223 R, 223 B, 210 R, 416/211, 238, 243, DIG. 2, DIG. 5; 417/352–354
See application file for complete search history.

(56) References Cited

U.S. PATENT DOCUMENTS

| | | | | |
|---|---|---|---|---|
| 65,252 | A | 5/1867 | McKenzie | |
| 195,865 | A | 10/1877 | Wilson | |
| 1,779,026 | A | 10/1930 | Wragg | |
| 3,708,244 | A | 1/1973 | Dawson et al. | |
| 4,326,836 | A | 4/1982 | Fitton | |
| 6,206,641 | B1 | 3/2001 | Park et al. | |
| 6,345,956 | B1 * | 2/2002 | Lin | 416/178 |
| 6,568,907 | B2 | 5/2003 | Horng et al. | |
| 6,579,064 | B2 | 6/2003 | Hsieh | |
| D486,569 | S | 2/2004 | Chen et al. | |
| 7,063,510 | B2 | 6/2006 | Takeshita et al. | |
| 7,118,345 | B2 | 10/2006 | Wu et al. | |
| D587,363 | S | 2/2009 | Rheault | |
| 8,202,055 | B2 * | 6/2012 | Wu et al. | 416/210 R |
| 2002/0127113 | A1 | 9/2002 | Kwon et al. | |
| 2004/0258527 | A1 * | 12/2004 | Kaneko et al. | 416/182 |
| 2005/0058543 | A1 * | 3/2005 | Takeshita et al. | 415/206 |
| 2005/0249604 | A1 * | 11/2005 | Wu et al. | 416/244 R |

(Continued)

*Primary Examiner* — Christopher Verdier
(74) *Attorney, Agent, or Firm* — Haugen Law Firm PLLP

(57) ABSTRACT

An impeller for a centrifugal fan includes a hub, impeller blades, and struts for supporting the blades in a circumferential array spaced apart from the hub. The number of struts can equal the number of blades, each strut extended from the hub to support two blades while each blade is supported by one strut nearer to its leading edge and another strut nearer to its trailing edge. Another arrangement features two struts per blade, with one of the struts coupled to the hub and a given blade, and the other strut coupled between the given blade and an adjacent blade. The struts are recessed inwardly from the leading and trailing edges to promote smoother air flow. The blades and struts are provided with aerodynamic thickness profiles to further improve air flow.

32 Claims, 7 Drawing Sheets

(56) References Cited

U.S. PATENT DOCUMENTS

2007/0065279 A1 3/2007 Lin et al.
2007/0217908 A1* 9/2007 Ochiai et al. ..... 415/206
2007/0274834 A1 11/2007 Huang et al.
2008/0130226 A1 6/2008 Yamashita et al.
2008/0226446 A1 9/2008 Fujieda
2009/0028710 A1 1/2009 Horng et al.

* cited by examiner

HIGH EFFICIENCY LOW-PROFILE CENTRIFUGAL FAN

This application claims the benefit of priority based on Provisional Application No. 61/242,853 entitled "High Efficiency Low-Profile Centrifugal Fan," filed Sep. 16, 2009.

BACKGROUND OF THE INVENTION

The present invention relates to cooling systems for computers and other electronic devices, and more particularly to low-profile, compact centrifugal air impellers designed to operate at high speeds.

Designers of a wide variety of electronic devices continually strive to provide more utility in smaller packages. Notebook or laptop computers illustrate this trend, in terms of the ongoing efforts to reduce their size and at the same time enlarge their capacity and capability to store and manipulate data. These devices generate heat during use, with increased functionality leading to increased heat generation. Failure to remove excess heat subjects these devices to a variety of risks ranging from reduced efficiency to serious and permanent damage.

Thus, designers of cooling systems for these devices face the dual and competing goals of smaller size and increased capacity for removing heat.

Typically, notebook computers have been designed to incorporate an internal housing or compartment for a dual-inlet, centrifugal type fan. In one conventional design, blades of constant thickness are attached directly to a rotor hub at their leading edges and extend away from the hub in "backwardly-inclined" fashion. This design can be molded with relative ease at low cost, but entails several disadvantages that become more pronounced in a reduced size, higher speed environment. One is the lack of an aerodynamically effective approach to drawing air into the blades. High speeds lead to distortion of the blades, further reducing efficiency and generating unwanted noise.

Efforts to solve these problems have lead to designs featuring structural or guide members along the blades, either on the positive pressure side as in U.S. patent application, Publication No. 2008/0130226 (Yamashita et al.), or on the leeward side as in U.S. patent application, Publication No. 2009/0028710 (Horng et al.). Another known approach involves selectively varying the blade thickness as shown in U.S. Pat. No. 6,579,064 (Hsieh) and U.S. Pat. No. 7,118,345 (Wu et al.).

In yet another approach the blades, particularly including their leading edges, are separated from the primary hub structure. This has been accomplished with an angular plate extending from the hub as shown in U.S. Pat. No. 6,568,907 (Horng et al.), or with a ring supported radially outwardly from the hub, as in U.S. patent application, Publication No. 2008/0226446 (Fujieda) and the aforementioned Wu patent.

Yet another approach is to support the blades individually with posts or other members at their leading edges. Examples of this approach include U.S. Pat. No. 7,063,510 (Takeshita et al.) and U.S. patent application, Publication No. 2007/0274834 (Huang et al.).

Although the forgoing examples and similar approaches have led to improved performance compared to the directly attached linear constant thickness blade design, the above-identified problems persist. Accordingly, the present invention is characterized by several aspects directed to one or more of the following objects:

- to provide an impeller with a mounting structure that locates the impeller blades in spaced apart relation to a hub while providing more stable support for the blades;
- to provide an impeller including a plurality of struts for supporting a plurality of impeller blades in surrounding, spaced apart relation to a hub in a manner that provides positive support to each blade at forward and rearward regions thereof, for improved stability;
- to provide, in a centrifugal fan impeller, impeller blades and blade-supporting struts with profiles shaped for improved aerodynamic efficiency; and
- to provide an impeller construction that facilitates independent optimization of blade inlet and discharge angles.

SUMMARY OF THE INVENTION

To achieve theses and other objects, there is provided a centrifugal fan. The fan includes a hub rotatable on a hub axis. The hub has a hub outer periphery disposed circumferentially about the hub axis. The fan comprises a plurality of blades. A blade mounting structure, narrower axially than the blades, supports the blades integrally relative to the hub and spaced apart from the hub in a circumferential sequence about the hub. The mounting structure supports the blades for rotation with the hub about the hub axis in a forward rotational direction to determine in each blade a leading edge and a trailing edge. Each blade comprises a forward region encompassing the leading edge and a rearward region behind the forward region and encompassing the trailing edge. The blade mounting structure comprises a plurality of blade-supporting struts. Each strut is coupled to the hub periphery, to the rearward region of a first one of the blades associated with the strut, and to the forward region of a second one of the blades associated with the strut. The second associated blade immediately follows the first associated blade in the sequence.

A prominent feature of the centrifugal fan is the combination of two-point anchoring of each blade and a one-to-one correspondence of struts to blades. Securing each blade at its forward region and at its rearward region reduces blade distortion and vibration. This is advantageous in any event and particularly at high speeds. For example, while conventional centrifugal fans of this kind typically are operated at rotational speeds up to 5,000 RPM (revolutions per minute), fans with two-point anchoring pursuant to the present invention can be operated at speeds up to 10,000 RPM with minimal blade distortion. Supporting each blade with two struts rather than one allows the use of reduced profile, lighter weight struts. Each pair of struts supporting a blade can have a combined mass comparable to a single strut in prior designs. Smaller struts with more aerodynamic profiles lead to less turbulent flow across the blade surfaces.

In preferred versions of the fan, the struts are recessed from the blade leading and trailing edges. This leaves portions of the forward and rearward blade regions with smooth profiles uninterrupted by the struts, to promote a more laminar and less turbulent air flow.

To further enhance air flow, each of the struts has an axial thickness less than its circumferential width. The axial thickness advantageously varies gradually between a maximum thickness along a medial region of the strut and reduced thicknesses at the strut forward and rearward edge portions.

Another aspect of the invention is a centrifugal impeller. The centrifugal impeller includes a hub rotatable on a hub axis and having a hub outer periphery disposed circumferentially about the hub axis. The impeller further includes a plurality of blades. A blade mounting structure, narrower axially than the blades, supports the blades integrally relative to the hub and spaced apart from the hub in a circumferential sequence about the hub for rotation with the hub about the hub axis in a forward direction. This determines in each blade a leading edge and a trailing edge. The blade mounting structure further supports the blades inclined relative to the hub. This selects one of the leading and trailing edges as a proximate edge spaced radially from the hub outer periphery by a first distance, and selects the other of the leading and trailing edges as a remote edge spaced radially from the hub outer periphery by a second distance greater than the first distance. The blade mounting structure comprises a plurality of first structural segments coupled with respect to the hub and associated individually with the blades. Each first structural segment is coupled to its associated blade at a first location near the proximate edge. The blade mounting structure further comprises a plurality of second structural segments associated individually with adjacent pairs of the blades. Each second structural segment is coupled to a first blade of its associated pair at a second location between the first location and the remote edge, and further is coupled to a second blade of the associated pair to couple said first and second blades.

The impeller features a blade mounting structure that supports each blade with structural segments at two locations, a first location near the proximate edge and a second location between the first location and the remote edge. Two spaced apart structural segments, preferably struts, replace a single, massive blade mounting structure. Accordingly, the advantages of increased stability and more aerodynamically effective air flow can be achieved as compared to the single blade mounting structure. To further improve air flow, the first and second locations can be recessed from the proximate edge and remote edge, respectively.

In one version of the impeller, the second structural segment is coupled to the second blade of the associated pair at a location that coincides with the first location. The second structural segment and its associated first structural segment are aligned end to end, and resemble a single strut extending from the hub and through the second blade toward a point of attachment to the first blade. In an alternative version of the impeller, the second structural segment is coupled to the second blade at a third location disposed between the first location and the second location.

In preferred versions of the impeller, the blades are backwardly curved. In these versions, the proximate edge of each blade is the leading edge, and the remote edge is the trailing edge. However, the principles can as well be applied to impellers with forwardly curved blades to achieve similar advantages.

Another aspect of the invention is an aerodynamic centrifugal fan impeller. The impeller includes a hub rotatable on a hub axis and having a hub outer periphery disposed circumferentially about the hub axis. The impeller further includes a plurality of blades. A plurality of blade-supporting struts are integrally coupled to the blades and to the hub periphery to support the blades radially spaced apart from the hub in a circumferential sequence about the hub. The struts support the blades for rotation with the hub about a hub axis in a forward rotational direction to determine in each blade a leading edge and a trailing edge. Each blade further comprises a forward region encompassing the leading edge, a rearward region encompassing the trailing edge, and a medial region between the forward region and the rearward region. Each of the blades has a blade width in the axial direction, and a blade thickness that varies gradually between a first thickness proximate the leading edge and a second thickness along the medial region. The blade thickness further varies gradually between the second thickness and a third thickness proximate the trailing edge. Each of the first and third thicknesses is less than the second thickness. Each of the struts has a circumferential width, and an axial thickness less than the blade width that varies gradually between a maximum thickness along a medial portion of a strut and reduced thicknesses at forward and rearward edge portions of the strut.

Thus, the blades and the struts have thickness profiles that diverge from a forward edge to a maximum thickness along a medial region or midportion, then converge to a reduced thickness at a rearward edge. This promotes a smoother, more laminar air flow in the rearward direction along the blades and struts. The profiles can be curved on one side, curved on both sides, or substantially identically curved on both sides to be symmetrical about a bisecting plane. In a particularly preferred version, the thickness of the blades is controlled to provide a maximum thickness along the medial region ranging from 1.25 to 1.40 times the blade thickness at the leading edge.

Mounting of the struts to the blades at locations recessed from the leading and trailing edges further enhances aerodynamic performance. Each of the struts can be coupled to one of the blades at its forward region and to the next adjacent blade at its rearward region, for improved stability with a one-to-one correspondence of struts and blades as previously noted. To further enhance this feature in an impeller with rearwardly curved blades, the struts can be curved forwardly in a generally radial direction of extension away from the hub.

Thus in accordance with the present invention, a centrifugal impeller locates the impeller blades spaced apart from the hub in a secure, stable fashion to minimize distortion and vibration at high speeds, and with considerably improved aerodynamic performance for more effective heat dissipation.

IN THE DRAWINGS

For a further understanding of the above and other features, reference is made to the following detailed description and to the drawings, in which.

Figure 7:
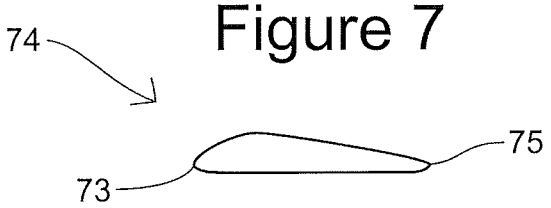
Figure 8:
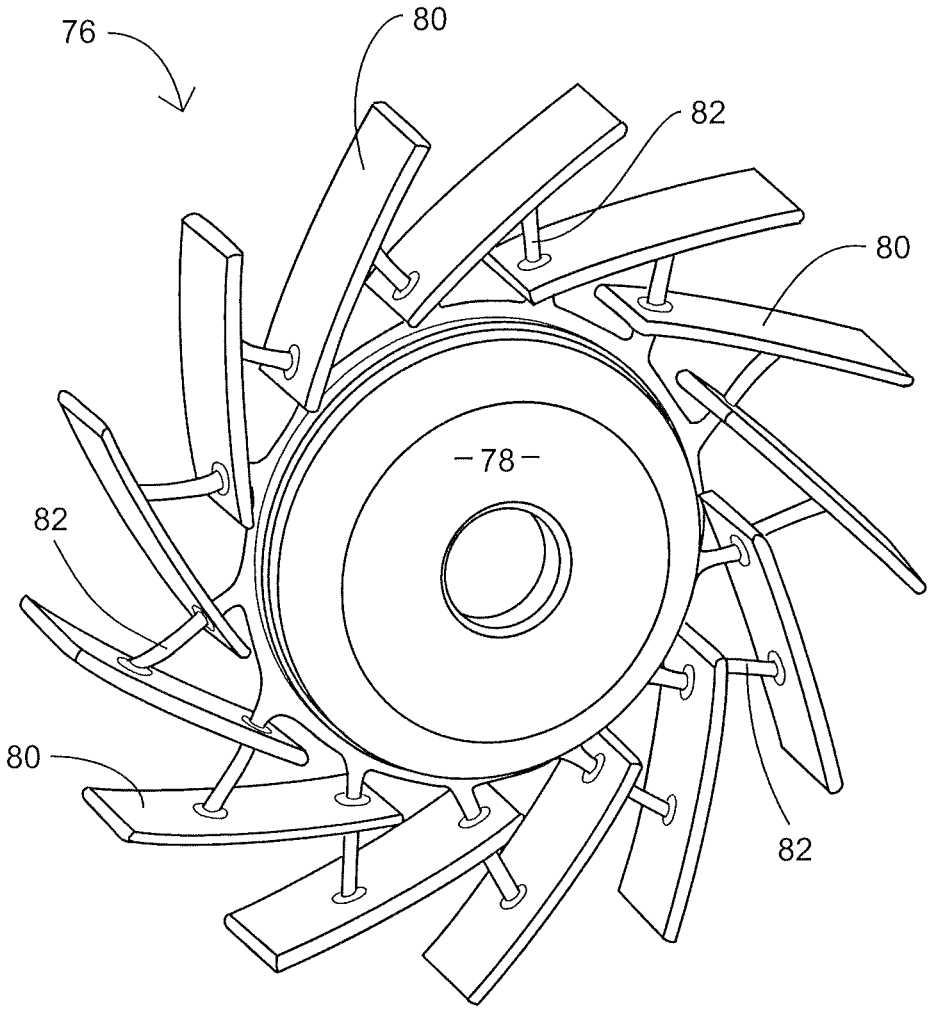
Figure 9:
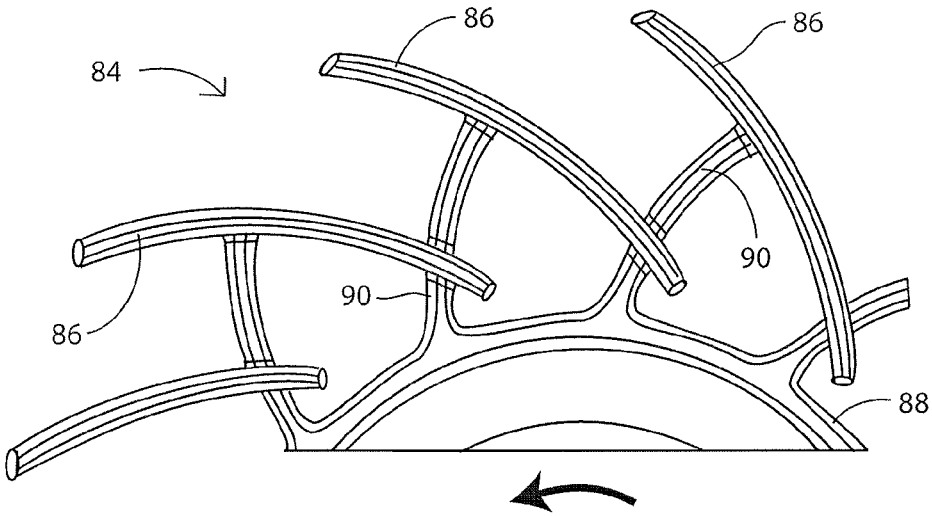
Figure 10:
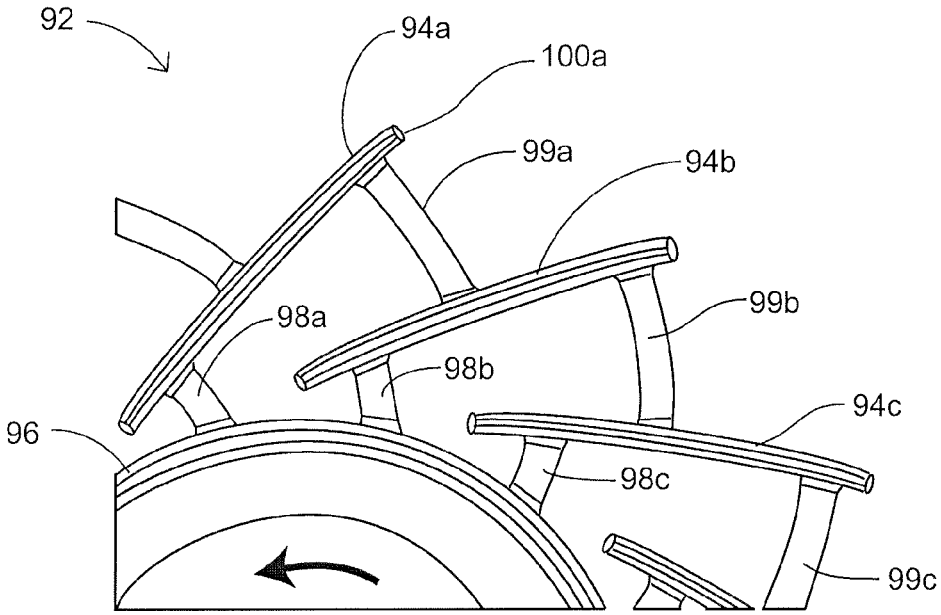
Figure 11:
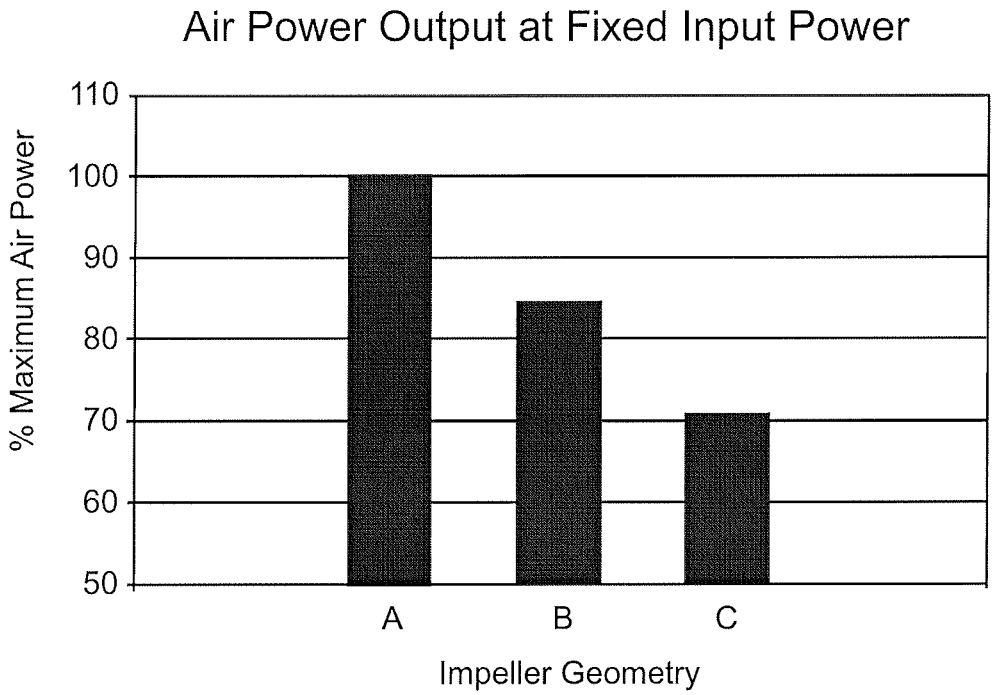

FIG. 7 schematically illustrates an alternative strut thickness profile;

FIG. 8 is an isometric view showing an alternative embodiment impeller;

FIG. 9 is a schematic view showing part of another alternative embodiment impeller;

FIG. 10 is a schematic view showing part of a further alternative embodiment impeller; and FIG. 11 is a chart comparing air power output for different impeller designs.

DETAILED DESCRIPTION OF THE PREFERRED EMBODIMENTS

Figure 1:
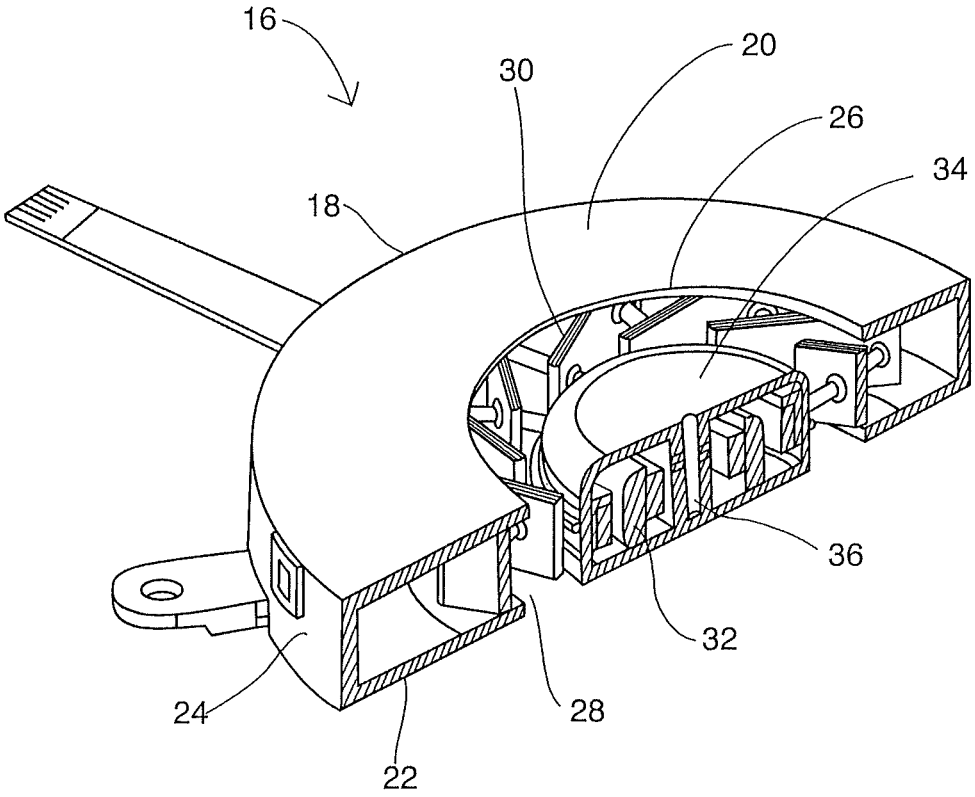
FIG. 1 is a partial, sectioned view of a convective cooling system constructed in accordance with the present invention.

Turning now to the drawings, there is shown in FIG. 1 a convective cooling system 16 intended for placement inside of a notebook or laptop computer. Cooling system 16 is operable while the notebook computer is in use, to remove or dissipate heat generated by the electrical components.

The cooling system includes a housing 18 with a top wall 20 and a bottom wall 22 that determine a circular housing profile, and an annular side wall 24. A central opening 26 in the top wall, and a similarly sized central opening 28 in the bottom wall, provide opposite side inlets that accommodate the flow of air into the cooling system. Air flow out of the system is accommodated in a known manner by one or more openings through side wall 24, not shown.

Housing 18 contains an impeller 30 and a motor for rotating the impeller about a vertical impeller axis relative to the housing. Components of the motor include stator windings 32 arranged about the axis and fixed with respect to the housing. Impeller 30 includes a central hub 34 mounted on a spindle 36 for rotation about the impeller axis. The hub integrally contains several motor components, including a back iron and one or more permanent magnets.

Figure 2:
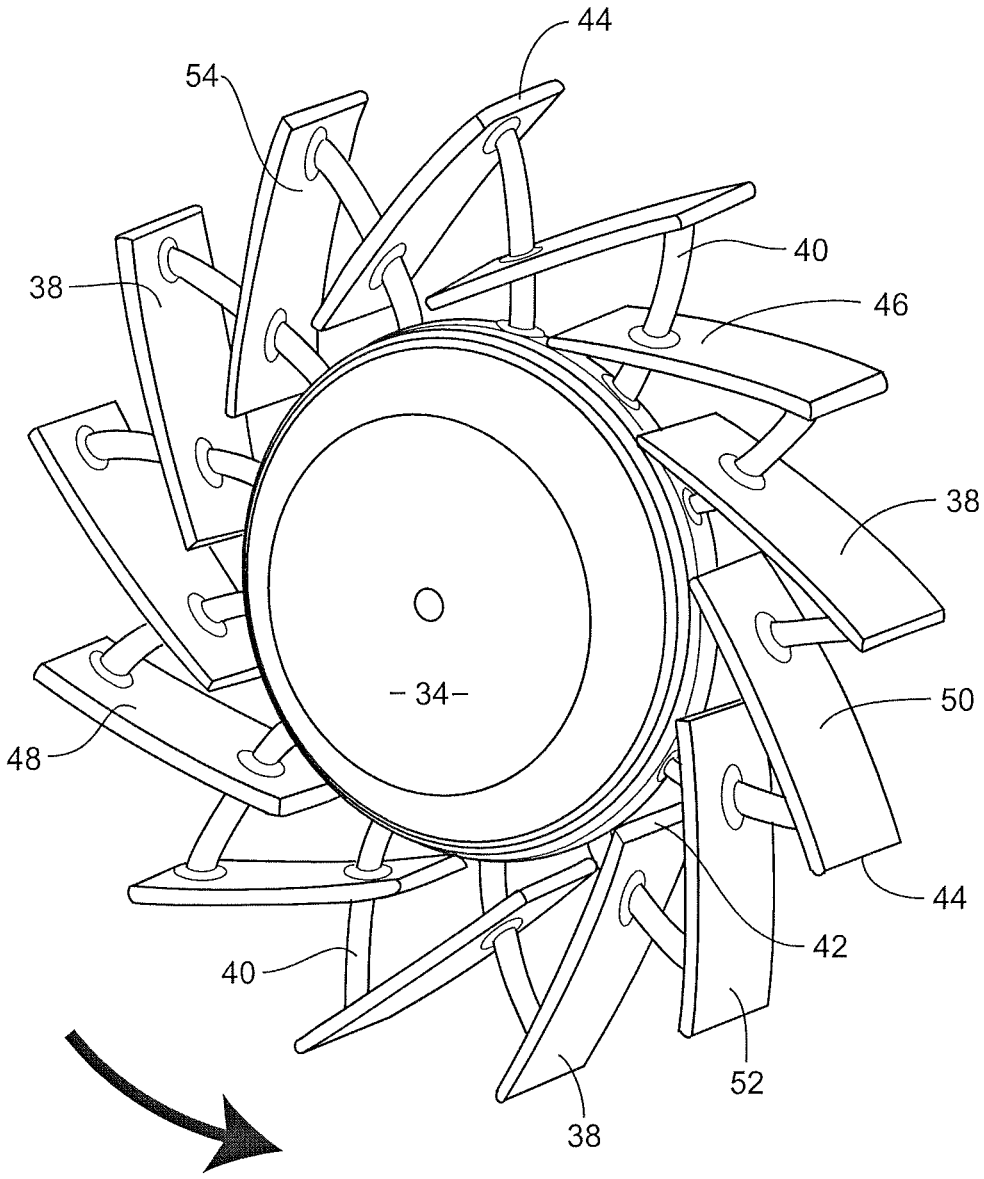
FIG. 2 is an isometric view showing an air impeller of the cooling system.

As seen in FIG. 2, impeller 30 includes a plurality of impeller blades 38, arranged in a sequence circumferentially about hub 34 for rotation with the hub about the axis. Blades 38 have a constant width in the axial direction, about equal to the axial height of hub 34 as perhaps best seen in FIG. 1. In alternative impeller configurations, the blade width may vary, and the axial height of the hub may be considerably more than the axial width of the blades. The blades are longer than they are wide. Impeller 30 includes thirteen blades, and in similar versions of the impeller, the number of blades may range from eleven to nineteen.

A plurality of struts 40 support blades 38 in radially spaced apart relation to hub 34. There is a one-to-one correspondence of struts to blades, in that each blade is supported by two of the struts and each of the struts supports two adjacent blades.

As indicated by the arrow in FIG. 2, impeller 30 rotates about the axis in the counterclockwise direction. Thus, with reference to FIG. 3, edges 42*a*, 42*b*, and 42*c* of blades 38*a*, 38*b*, and 38*c* are leading edges with a relatively close radial spacing from hub 34. Edges 44*a* and 44*b* are trailing edges of blades 38*a* and 38*b*, radially more remote from the hub axis. Blades 38 are backwardly curved, in the sense that their radial distance from the hub axis progressively increases in the rearward direction. In terms of radial spacing from the center of hub 34, blades 38 are positioned to determine a ratio R1/R2 in the range of 0.6 to 0.5, where R1 is the radial spacing of each blade leading edge 42 and R2 is the radial spacing of the blade trailing edge.

Figure 3:
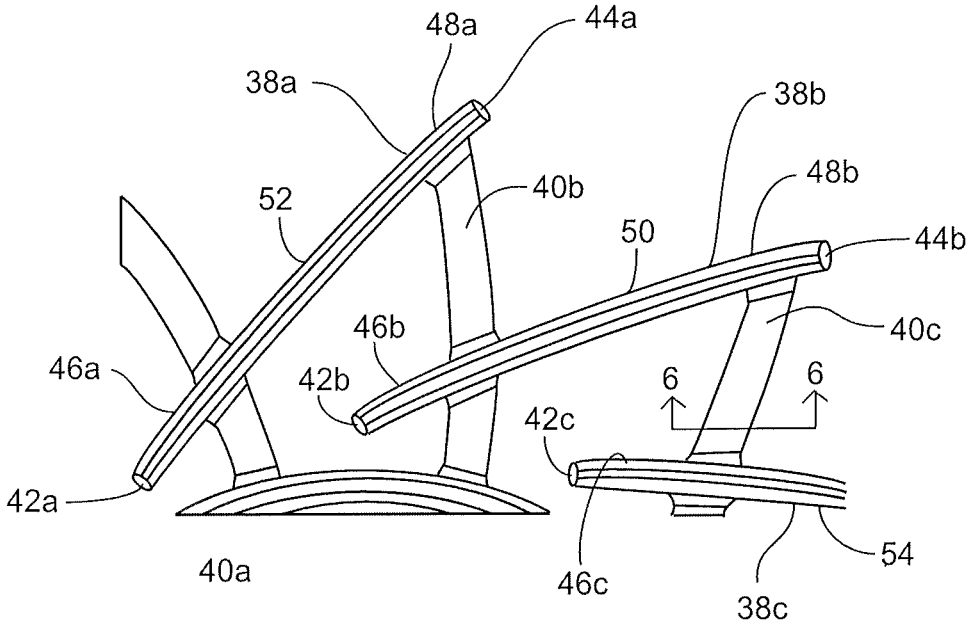
FIG. 3 is an enlarged partial, top plan view of the impeller.

With further reference to FIG. 3, each of blades 38 includes a forward region 46 that encompasses the leading edge, a rearward region 48 encompassing the trailing edge, and a medial region 50 between the forward and rearward regions. Each of struts 40 supports two adjacent blades. For example, strut 40*b* is coupled to hub 34, blade 38*b* along forward region 46*b*, and to blade 38*a* along rearward region 48*a*. In similar fashion, each of the struts supports two adjacent blades.

Likewise, each blade is supported by two adjacent struts. Blade 38*b*, for example, is supported at its forward region 46*b* by strut 40*b*, and supported at its rearward region 48*b* by strut 40*c*.

Impeller 30 preferably is formed as a single piece by injection molding, using an engineered plastic such as glass-filled nylon or a metal such as magnesium. Accordingly, strut 40*b* "extends through" blade 38*b* on the way to blade 38*a* in a functional rather than literal sense. Alternatively, strut 40*b* might be considered to include a radially inward strut segment mounting blade 38*b* with respect to hub 34, and a radially outward strut segment mounting blade 38*a* with respect to blade 38*b*. In any event, each strut is integrally coupled to the hub, the forward region of an associated strut, and the rearward region of the adjacent associated strut to firmly support the blades in a manner that minimizes distortion and vibration.

Blades 38 are aerodynamically designed for enhanced air flow through system 16. Each blade has a diverging and converging thickness. More particularly, the thickness increases gradually from leading edge 42 to maximum thickness along medial region 50, then diminishes gradually to a reduced thickness at trailing edge 44. In blades 38, this is accomplished primarily through selective curvature of a positive pressure side 52 and to a lesser extent the curvature of a suction side 54 of the blade.

In preferred versions of blade 38, the maximum thickness ranges from 1.25 to 1.40 times the thickness at the leading edge. This ratio, combined with the progressive and gradual increase in thickness backwardly from the leading edge, provides optimal efficiency by minimizing separation of airflow across the blade surfaces.

A selective curvature of positive pressure side 52 can afford the additional advantage of determining or setting the blade inlet angle and blade discharge angle independently of one another. The blade inlet angle is the angle between the meanline near the leading edge and a tangent of the hub taken at the leading edge. The discharge angle is the angle between the meanline near the blade trailing edge and a tangent of a circle centered on the hub axis with a radius extending to the trailing edge. As an example, in preferred versions of the impeller the inlet angle ranges from 22 degrees to 30 degrees, and the discharge angle ranges from 44 degrees to 52 degrees.

Figure 4:
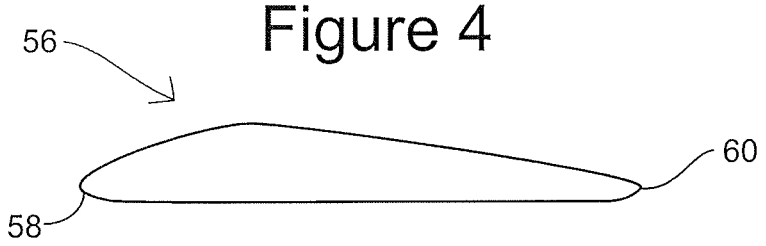
FIGS. 4 and 5 show alternative impeller blade thickness profiles.
Figure 5:
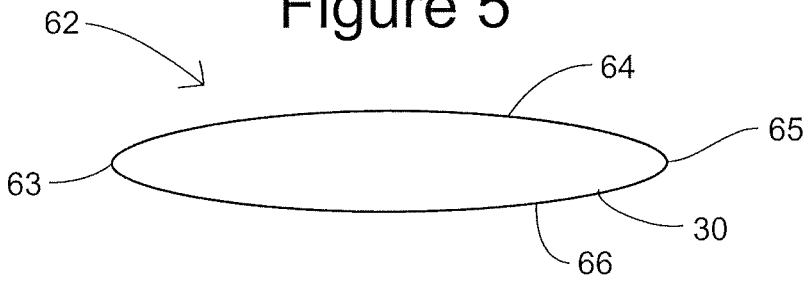

FIGS. 4 and 5 illustrate alternative blade thickness profiles. In FIG. 4, an impeller blade 56 exhibits a more pronounced increase in thickness from a leading edge 58 to a maximum thickness near a forward end of its medial region, followed by a more gradual reduction in thickness to a trailing edge 60. In the broader sense of providing smooth transitions without abrupt changes, both the increase and decrease in thickness can be characterized as "gradual." In FIG. 5, an impeller blade 62 is curved along its positive pressure side 64 and its leeward side 66 to provide the desired divergence and convergence between a leading edge 63 and a trailing edge 65. The opposite sides in FIG. 5 can be symmetrical about a bisecting plane.

Figure 6:
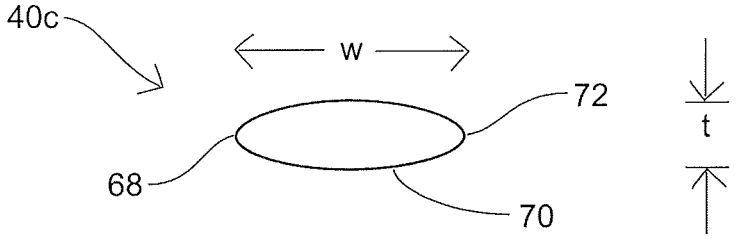
FIG. 6 is a sectional view taken along the line 6-6 in FIG. 3.

FIG. 6 illustrates the profile of strut 40*c* in a plane substantially perpendicular to the strut length, to illustrate the strut thickness profile. The strut has a width w substantially in the circumferential direction. The strut thickness t, perpendicular to the width, is considerably less than the strut width, and varies in diverging/converging fashion. That is, the thickness increases gradually from a forward edge 68 of a strut to point 70 of maximum thickness in a medial region of the strut, then is reduced gradually to a reduced thickness at a rearward edge 72 of the strut.

FIG. 7 illustrates an alternative strut 74 with forward and rearward edges 73 and 75, featuring a relatively steep divergence in thickness followed by a relatively gradual convergence. As noted above with respect to the blades, the divergence and convergence in strut thickness are both gradual in the broad sense of avoiding abrupt changes.

FIG. 8 illustrates an alternative embodiment impeller 76 with a hub 78, a plurality of impeller blades 80, and a plurality of struts 82 for supporting the impeller blades in a circumferential sequence about the hub in spaced apart relation to the hub. Impeller 76 differs from impeller 30 in that struts 82 are rearwardly curved instead of forwardly curved as they extend primarily radially away from the hub.

FIG. 9 illustrates another alternative embodiment impeller 84 in which blades 86 are supported spaced apart from a hub 88 by struts 90. Blades 86 are forwardly curved, in contrast to backwardly curved blades 38 and 80. In this embodiment, the remote edges of blades 86 are the leading edges, while the proximate edges are the trailing edges.

FIG. 10 illustrates a further embodiment impeller 92 in which backwardly curved impeller blades 94*a-c* are supported in spaced apart relation to a hub 96 by struts 98*a-c* and 99*a-c*. As compared to the struts in previous versions, struts 98 and 99 are circumferentially offset from one another. For example, shorter strut 98*a* is coupled to hub 96 and to blade 94*a* near its leading and proximate edge. Longer strut 99*a* is coupled to blade 94*a* near its trailing and remote edge, and further is coupled to blade 94*b* at a medial location between the locations along the blade at which struts 98*b* and 99*b* are coupled. This doubles the ratio of struts to blades, but affords more flexibility in terms of placing the struts with respect to the blades. More particularly, because strut 99*a* is offset rather than aligned end to end with strut 98*b*, it can be coupled to blade 94*a* at a point nearer to a trailing edge 100*a*.

In the preferred impeller, the struts are centered on a reference plane (not illustrated) passing through the hub and perpendicular to the hub axis. More preferably, the reference plane is axially centered with respect to the hub. In alternative impellers, the struts are staggered to position adjacent struts on opposite sides the reference plane. The staggered arrangements require an even number of struts, and thus require an even number of blades in arrangements featuring a one-to-one correspondence of struts to blades. Staggered struts may be parallel to or inclined relative to the reference plane.

In an embodiment of the invention the struts are substantially equally spaced about the hub. Also, in an embodiment of the invention each of the struts is substantially centered with respect to a plane perpendicular to the hub axis. Further, in an embodiment of the invention the blades have a substantially constant width in the axial direction. Additionally, in an embodiment of the invention the axial width of the blades is substantially constant. Further, in an embodiment of the invention the struts are substantially equally spaced about the hub. Also, in an embodiment of the invention the struts are substantially centered with respect to a plane perpendicular to the hub axis.

Impellers designed in accordance with the present invention are more efficient in terms of the air power output generated in response to a given level of input power. FIG. 11 is a chart illustrating different levels of air power output at a fixed input power for several impeller designs.

Three different impellers were tested in the same system. One of the impellers was a conventional design in which the impeller blades were linear and of constant thickness. The blades were backwardly inclined. The blades were attached directly to the hub, with their leading edges contiguous with the hub. This design is represented by the bar labeled "C" in FIG. 11.

A second impeller was like the first in that its blades were of constant thickness and their leading edges were contiguous with the hub. This impeller differed from the first in that its blades were backwardly curved. This design is represented by the bar labeled "B" in the chart.

The final impeller, represented by the bar labeled "A," also had backwardly curved blades. In accordance with the present invention, the thickness of the blades varied gradually between a maximum thickness along a medial region of the blade and reduced thicknesses near the blade leading and trailing edges. Further, the leading edges of the blades were spaced apart radially from the hub, supported relative to the hub by aerodynamically designed struts.

A comparison of the bars B and C in FIG. 11 illustrates the improvement in efficiency that results simply from introducing curvature in the impeller blades. Comparison of bar A with bar B illustrates the considerable further improvement in efficiency achieved by separating the blade leading edges from the hub to allow airflow through a radial gap between each blade and the hub, and by selectively varying the blade thickness to improve aerodynamics and independently control curvature along the positive pressure surface and the suction surface of the blade. Thus, the improved impeller is capable of removing more excess heat at a given input power level, or alternatively producing the same cooling effect at a reduced input power level.

In accordance with the present invention, an impeller for a centrifugal fan is improved structurally and aerodynamically for moving more air through a cooling system at higher speeds. The impeller blades are supported in spaced apart relation to the hub at locations proximate but recessed from the blade leading and trailing edges, to provide a favorable combination of smoother air flow and increased stability. Multiple strut-to-blade couplings enable the use of smaller, lighter weight struts to provide the desired stability. Aerodynamically designed struts further enhance airflow.

What is claimed is:

1. A centrifugal fan, including:

a hub rotatable on a hub axis and having a hub outer periphery disposed circumferentially about the hub axis;

a plurality of blades spaced apart from the hub; and a blade mounting structure, narrower axially than the blades, supporting the blades integrally relative to the hub and spaced apart from the hub in a circumferential sequence about the hub for rotation with the hub about the hub axis in a forward rotational direction to determine in each blade a leading edge and a trailing edge, wherein each blade comprises a forward region encompassing the leading edge and a rearward region behind the forward end region and encompassing the trailing edge;

wherein the blade mounting structure comprises a plurality of blade-supporting struts, each strut being coupled to the hub periphery, to the rearward region of a first one of the blades associated with the strut, and to the forward region of a second one of the blades associated with the strut, wherein the second associated blade immediately follows the first associated blade in said sequence.

2. The fan of claim 1 wherein:

the blades are backwardly curved, and the rearward region of the first associated blade is disposed radially outwardly of the forward region of the second associated blade.

3. The fan of claim 1 wherein:

each of the struts is coupled to its second associated blade at a first location spaced apart rearwardly from the leading edge of the second associated blade.

4. The fan of claim 3 wherein:

each of the struts is coupled to its first associated blade at a second location spaced apart forwardly from the trailing edge of the first associated blade.

5. The fan of claim 1 wherein:

each of the struts has a width in the circumferential direction, and a thickness in the axial direction less than the width.

6. The fan of claim 5 wherein:

the axial thickness of the strut varies gradually between a maximum thickness along a medial portion of the strut and reduced thicknesses at forward and rearward edge portions of the strut.

7. The fan of claim 1 wherein:
the struts are substantially equally spaced about the hub.
8. The fan of claim 1 wherein:
each of the struts is substantially centered with respect to a plane perpendicular to the hub axis.
9. The fan of claim 1 wherein:
the struts are curved forwardly in the direction of radial extension away from the hub.
10. The fan of claim 1 wherein:
the blades have a substantially constant width in the axial direction.
11. The fan of claim 10 wherein:
each of the blades further comprises a medial region between the forward region and the rearward region, and has a thickness that varies gradually between a first thickness proximate the leading edge and a second thickness along the medial region, wherein the second thickness is in the range from 1.25 to 1.40 times the first thickness.
12. The fan of claim 11 wherein:
the thickness of each of the blades further varies gradually between the second thickness and a third thickness proximate the trailing edge, and the third thickness is less than the second thickness.
13. The fan of claim 1 wherein:
the plurality of blades consists essentially of a number of blades within the range of 11 to 19.
14. The fan of claim 1 further including:
a stationary housing surrounding the hub and blade and defining air inlet passages on opposite sides of the hub near the hub axis;
a motor stator integral with the housing and disposed about the hub axis; and
a rotor integral with the hub and disposed about the hub axis.
15. A centrifugal impeller, including:
a hub rotatable on a hub axis and having a hub outer periphery disposed circumferentially about the hub axis;
a plurality of blades; and
a blade mounting structure, narrower axially than the blades, supporting the blades integrally relative to the hub and spaced apart from the hub in a circumferential sequence about the hub for rotation with the hub about the hub axis in a forward direction to determine in each blade a leading edge and a trailing edge, the blade mounting structure further supporting the blades inclined relative to the hub to select one of the leading and trailing edges as a proximate edge spaced radially from the hub outer periphery by a first distance and to select the other of said leading and trailing edges as a remote edge spaced radially from the hub outer periphery by a second distance greater than the first distance;
wherein the blade mounting structure comprises a plurality of first structural segments coupled with respect to the hub and associated individually with the blades, with each first structural segment coupled to its associated blade at a first location near the proximate edge, the blade mounting structure further comprising a plurality of second structural segments associated individually with adjacent pairs of the blades, each second structural segment coupled to a first blade of its associated pair at a second location between the first location and the remote edge and coupled to a second blade of the associated pair to couple the first and second blades.
16. The impeller of claim 15 wherein:
the first location of each of the blades is recessed from the proximate edge, and the second location of each blade is recessed from the remote edge.
17. The impeller of claim 15 wherein:
the blades are backwardly curved, thereby to select in each blade the leading edge as the proximate edge and the trailing edge as the remote edge.
18. The impeller of claim 17 wherein:
each of the blades comprises a forward region encompassing the leading edge, a rearward region encompassing the trailing edge, and a medial region between the forward region and the rearward region, wherein a thickness of the blade varies gradually between a first thickness proximate the leading edge and a second thickness along the medial region, and the second thickness is in the range from 1.25 to 1.40 times the first thickness.
19. The impeller of claim 18 wherein:
the thickness of each of the blades further varies gradually between the second thickness and a third thickness proximate the trailing edge, and the third thickness is less than the second thickness.
20. The impeller of claim 15 further including:
a stationary housing surrounding the hub and blade and defining air inlet passages on opposite sides of the hub near the hub axis;
a motor stator integral with the housing and disposed about the hub axis; and
a rotor integral with the hub and disposed about the hub axis.
21. The impeller of claim 15 wherein:
the blades are forwardly curved, thereby to select in each blade the leading edge as the remote edge, and the trailing edge as the proximate edge.
22. The impeller blade of claim 15 wherein:
the first and second structural segments comprise struts, each strut having a circumferential width and an axial thickness that is less than the width and varies gradually between a maximum thickness along a medial portion of the strut and reduced thicknesses at forward and rearward edge portions of the strut.
23. The impeller of claim 15 wherein:
each of the second structural segments is coupled to the second blade of its associated pair at a location that coincides with the first location.
24. The impeller of claim 15 wherein:
each of the second structural segments is coupled to the second blade of its associated pair at a third location disposed between the first location and the second location.
25. An aerodynamic centrifugal fan impeller, including:
a hub rotatable on a hub axis and having a hub outer periphery disposed circumferentially about the hub axis;
a plurality of blades radially spaced apart from the hub; and
a first plurality of blade-supporting struts integrally coupled between the blades and a second plurality of blade-supporting struts integrally coupled to the hub periphery and the blades to support the blades radially spaced apart from the hub in a circumferential sequence about the hub for rotation with the hub about a hub axis in a forward rotational direction to determine in each blade a leading edge and a trailing edge, each blade further comprising a forward region encompassing the leading edge, a rearward region encompassing the trailing edge, and a medial region between the forward region and the rearward region;
wherein each of the blades has a blade width in the axial direction, and a blade thickness that varies gradually between a first thickness proximate the leading edge and a second thickness along the medial region, and further varies gradually between the second thickness and a third thickness proximate the trailing edge, wherein each of the first and third thicknesses is less than the second thickness; and each of the struts has a circumferential width, and an axial thickness less than the blade width that varies gradually between a maximum thickness along a medial portion of a strut and reduced thicknesses at forward and rearward edge portions of the strut.

26. The impeller of claim 25 wherein:

the second thickness is in the range from 1.25 to 1.40 times the first thickness.

27. The impeller of claim 25 wherein:

the axial width of the blades is substantially constant.

28. The impeller of claim 25 wherein:

the struts are substantially equally spaced about the hub.

29. The impeller of claim 25 wherein:

each of the struts is substantially centered with respect to a plane perpendicular to the hub axis.

30. The impeller of claim 25 wherein:

the struts are curved forwardly in a generally radial direction of extension away from the hub.

31. The impeller of claim 25 wherein:

the struts are coupled to the blades at respective first locations within the forward regions spaced apart rearwardly from the respective leading edges, and at second locations within the respective rearward regions spaced apart forwardly from the respective trailing edges.

32. The impeller of claim 25 wherein:

each of the struts is coupled to the hub periphery, to the rearward region of a first one of the blades, and to a forward region of a second one of the blades, wherein the second blade immediately follows the first blade in said sequence.

* * * * *